US006685661B2

(12) United States Patent
Peled

(10) Patent No.: US 6,685,661 B2
(45) Date of Patent: Feb. 3, 2004

(54) MEDICAL DEVICE FOR APPLYING CYCLIC THERAPEUTIC ACTION TO A SUBJECT'S FOOT

(75) Inventor: Omer Peled, Haifa (IL)

(73) Assignee: Medical Dynamics LLC, USA, San Francisco, CA (US)

( * ) Notice: Subject to any disclaimer, the term of this patent is extended or adjusted under 35 U.S.C. 154(b) by 0 days.

(21) Appl. No.: 10/014,551

(22) Filed: Dec. 11, 2001

(65) Prior Publication Data

US 2002/0133106 A1 Sep. 19, 2002

(30) Foreign Application Priority Data

Dec. 14, 2000 (IL) ..... 140315

(51) Int. Cl.[7] ..... A61H 9/00
(52) U.S. Cl. ..... 601/149; 601/150; 601/152
(58) Field of Search ..... 601/148, 149, 601/150, 151, 152, 22, 27; 36/29, 35 B, 3 R, 141; 602/13; 128/DIG. 20

(56) References Cited

U.S. PATENT DOCUMENTS

| | | | |
|---|---|---|---|
| 1,608,239 | A | 11/1926 | Rosett |
| 2,531,074 | A | 11/1950 | Miller |
| 2,823,668 | A | 2/1958 | Van Court et al. |
| 3,412,730 | A | 11/1968 | MacLeod |
| 3,454,010 | A | 7/1969 | Lilligren et al. |
| 3,683,897 | A | 8/1972 | Shield et al. |
| 3,789,836 | A | 2/1974 | Girten |
| 3,811,431 | A | 5/1974 | Apstein |
| 3,888,242 | A | 6/1975 | Harris et al. |
| 4,003,374 | A | 1/1977 | Mizrachy |
| 4,029,087 | A | 6/1977 | Dye et al. |
| 4,068,334 | A | 1/1978 | Randall |
| 4,186,734 | A | 2/1980 | Stratton |
| 4,453,538 | A | 6/1984 | Whitney |

(List continued on next page.)

FOREIGN PATENT DOCUMENTS

| | | |
|---|---|---|
| DE | 30 09 408 | 9/1981 |
| GB | 2 313 784 | 12/1997 |
| SU | 1452-523 | 1/1989 |
| WO | WO 88/09653 | 12/1988 |
| WO | WO 00/06077 | 2/2000 |
| WO | WO 02/47600 | 6/2002 |

*Primary Examiner*—Nicholas D. Lucchesi
*Assistant Examiner*—Quang D Thanh
(74) *Attorney, Agent, or Firm*—Fish & Neave; Daniel M. Becker; Douglas A. Oguss

(57) ABSTRACT

A medical device for applying a cyclic therapeutic action to a subject's foot, the device including a platform with at least three independently actuable inflatable bladders staggered therealong to solely underlie the subject's heel, his plantar arch and his foot's front portion including its metatarsals and its toes, respectively, whereby a traveling compressive wave can be cyclically applied to his foot's underside only.

26 Claims, 18 Drawing Sheets

U.S. PATENT DOCUMENTS 4,696,289 A 9/1987 Gardner et al.
4,793,328 A 12/1988 Kolstedt et al.
4,804,208 A 2/1989 Dye
4,938,208 A 7/1990 Dye
4,945,905 A 8/1990 Dye et al.
4,989,589 A 2/1991 Pekanmäki et al.
5,007,411 A 4/1991 Dye
5,014,681 A 5/1991 Neeman et al.
5,025,575 A 6/1991 Lakic
5,031,604 A 7/1991 Dye
5,117,812 A 6/1992 McWhorter
5,170,776 A 12/1992 Pecheux
5,186,163 A 2/1993 Dye
5,263,473 A 11/1993 McWhorter
5,288,286 A 2/1994 Davis
5,295,314 A * 3/1994 Moumdjian ..... 36/29
5,354,260 A 10/1994 Cook
5,396,896 A 3/1995 Tumey et al.
5,403,265 A 4/1995 Berguer et al.
5,443,440 A 8/1995 Tumey et al.
5,478,119 A 12/1995 Dye
5,591,200 A 1/1997 Cone et al.
5,598,645 A * 2/1997 Kaiser ..... 36/29
5,626,556 A 5/1997 Tobler et al.
5,688,225 A 11/1997 Walker
5,792,081 A 8/1998 Cross
5,795,312 A 8/1998 Dye
5,813,142 A 9/1998 Demon
5,840,049 A 11/1998 Tumey et al.
5,891,065 A 4/1999 Cariapa et al.
5,931,797 A 8/1999 Tumey et al.
5,937,462 A * 8/1999 Huang ..... 36/29
5,989,204 A 11/1999 Lina
6,146,347 A 11/2000 Porrata
6,254,556 B1 7/2001 Hansen et al.
6,296,617 B1 10/2001 Peeler et al.
6,305,102 B1 10/2001 Doyle
6,319,215 B1 11/2001 Manor et al.
6,463,612 B1 * 10/2002 Potter ..... 36/29
6,585,669 B2 7/2003 Manor et al.
2001/0018564 A1 8/2001 Manor et al.

* cited by examiner

MEDICAL DEVICE FOR APPLYING CYCLIC THERAPEUTIC ACTION TO A SUBJECT'S FOOT

REFERENCE TO RELATED APPLICATIONS

This application claims benefit of provisional Israel patent application Serial No. 140,315, filed Dec. 14, 2000, the entirety of which is incorporated herein by reference.

FIELD OF THE INVENTION

The invention is in the field of medical devices for applying a cyclic therapeutic action to a subject's lower limbs, and in particular to his feet.

BACKGROUND OF THE INVENTION

Many subjects suffering from a number of medical conditions including inter alia peripheral arterial and venous disease, hypertension, diabetes and deep vein thrombosis are treated by way of medical devices with one or more inflatable bladders for applying a cyclic therapeutic action to a subject's lower limbs, and in particular to his feet, for urging venous blood flow from his feet and legs to his heart.

Venous blood flow can be urged by stimulation of one or both of two physiological mechanisms, namely, his calf's venous muscular pump and emptying of his foot's venous plexus. Medical devices for stimulating one or both of these mechanisms are illustrated and described inter alia in U.S. Pat. Nos. 2,531,074, 3,454,010, 3,683,897, 3,789,836, 4,003,374, 4,696,289, 4,945,905, 4,989,589, 5,117,812, 5,354,260, 5,396,896, 5,443,440, WO 88/09653, DE 30 09 408, and SU 0 1452-523.

SUMMARY OF THE INVENTION

In accordance with a first aspect of the present invention, there is provided a medical device for applying a cyclic therapeutic action to a subject's foot, the device comprising a platform with at least three independently actuable inflatable bladders staggered therealong to solely underlie the subject's heel, his plantar arch and his foot's front portion including his metatarsus and his toes, respectively, whereby a traveling compressive wave can be cyclically applied to his foot's underside only.

The medical device preferably has four inflatable bladders staggered along its platform in a non-overlapping fashion to solely underlie a foot's heel, its plantar arch, its metatarsus, and its toes, respectively. In addition, the inflatable bladders are so dimensioned and the spacing apart therebetween is such that they are substantially co-extensive with a foot's underside. Also, the platform is preferably formed with an arched plantar arch support for permanently supporting a foot's plantar arch and an arched toe support for permanently supporting a foot's toes at their bases. Two basic embodiments of the medical device are envisaged: boot-like footwear designed to look like and be worn as conventional slippers worn in the home thereby precluding a person from having to change footwear for treatment purposes and, a normally flat, one-piece foldable wrap for more extended treatment periods, for example, when a subject is sleeping.

In accordance with a second aspect of the present invention, there is provided a medical device for applying a cyclic therapeutic action to a subject's foot, the device comprising boot-like footwear for accommodating a subject's entire foot, and at least one inflatable bladder permanently disposed in said footwear and being in fluid communication with a pressure source for selectively applying pressure to the foot's underside, characterized in that said footwear has an externally accessible connector member permanently and directly attached to an exterior surface thereof, said connector member being in permanent fluid communication with said inflatable bladder and in selectively disconnectable fluid communication with said pressure source. The pressure source is coupled to the inflatable chambers by tubular elements that may be guided to the inflatable chambers by channels recessed in the upper surface of the sole. The recessed channels may enter the sole from the side, the front, the back, or the underside of the sole.

In accordance with a third aspect of the present invention, there is provided a medical device for effecting dorsiflexion of a subject's foot, the device comprising a platform for supporting the subject's foot, and having an inflatable bladder for cyclically elevating the foot's front portion solely relative to said platform from a normal position thereatop whereby the foot's front portion is flexed relative to the foot's remaining portion overlying said platform, said inflatable bladder having a first compartment overlying said platform and a second compartment hingedly connected to said first compartment along a trailing edge of said inflatable bladder directed towards the subject's heel and limiting means for limiting the maximum height of an edge of said second compartment remote from said trailing edge on inflation of said inflatable bladder whereby said inflatable bladder assumes an inflated triangular shaped configuration tapering towards the subject's heel.

The particular design of the inflatable bladder is such that it enables a relatively high maximum height for a relatively small volume as say compared with a generally isosceles shaped inflatable of comparable dimensions, thereby enabling a high cycle rate even with a relatively small compressor.

In accordance with a fourth aspect of the present invention, there is provided a medical device for effecting dorsiflexion of a subject's foot, the device comprising a platform for supporting the subject's foot, and having a wedge shaped support tapering towards the subject's heel for permanently supporting the foot's front portion in a flexed position relative to the foot's remaining portion overlying said platform; and an inflatable bladder mounted on said support for cyclically elevating the foot's front portion relative thereto from a normal position thereatop.

In accordance with a fifth aspect of the present invention, there is provided a medical device for applying a cyclic therapeutic action to a subject's foot, the device comprising a platform for supporting the subject's foot, and having an arched plantar arch support for permanently supporting the foot's plantar arch; and an inflatable bladder for cyclically elevating the foot's front portion relative to said platform from a normal position thereatop whereby the subject's foot effects a rocking motion about said plantar arch support acting as a fulcrum-like member.

In accordance with a sixth aspect of the present invention, there is provided a kit for installation on a wheelchair having a pair of foot supports for supporting a wheelchair-bound subject's feet, the kit comprising: a rechargeable battery-operated compressor; a pair of medical devices capable of being in fluid communication with said compressor and mountable on a foot support, each medical device capable of applying a cyclic therapeutic action to a subject's foot; and a controller for controlling the operation of the medical devices.

By virtue of the kit of the present invention, a wheelchair bound subject can still undergo his everyday normal activities whilst receiving therapeutic treatment for poor venous blood flow by way of dorsiflexion of his feet and/or application of a traveling compressive wave to the underside of his feet.

In accordance with a seventh aspect of the present invention, there is provided a medical device for effecting plantar flexion of a subject's foot, the device comprising a mounting member for mounting the medical device on the subject's leg, an elongated support member attached to said mounting member and downward depending for overlying at least a proximal portion of the foot's anterior surface, an inflatable bladder extending along the underside of said support member; and a resiliently flexible foot restraining member attached midway along said support member for encircling the foot's plantar arch.

BRIEF DESCRIPTION OF THE DRAWINGS

In order to understand the invention and to see how it may be carried out in practice, preferred embodiments will now be described, by way of non-limiting examples only, with reference to the accompanying drawings, and in which.

DESCRIPTION OF THE PREFERRED EMBODIMENTS

Figure 1:
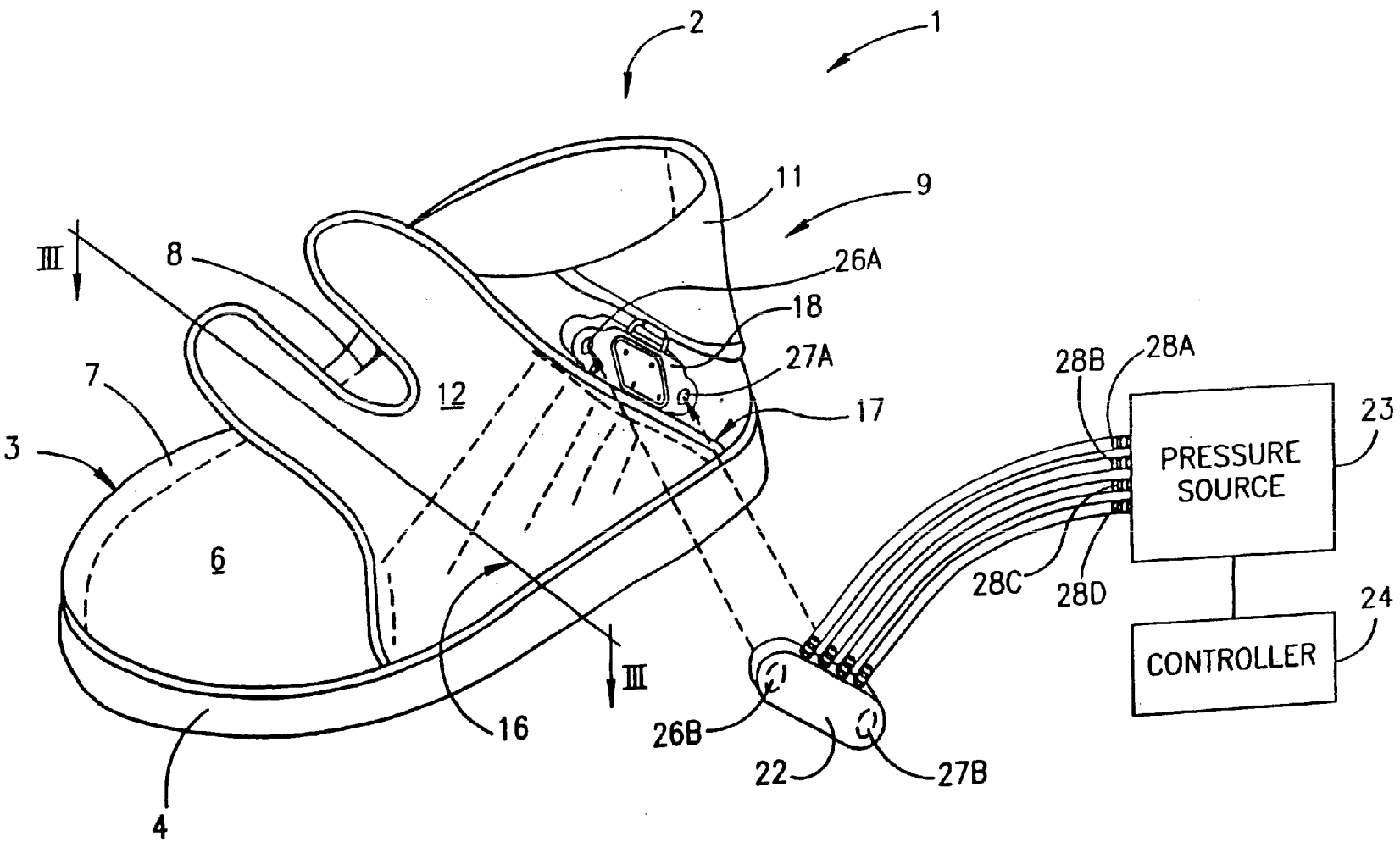
FIG. 1 is a pictorial view of a medical device implemented as boot-like footwear.

With reference now to FIGS. 1–4, a medical device 1 is implemented as boot-like footwear 2 designed to accommodate a subject's left foot, the footwear 2 being constituted by a vamp 3 made of fabric-like sheet material and a sole 4. The vamp 3 has left and right hand vamp halves 6 and 7 stitched together along their common edges except for their uppermost front portion 8 for enabling a subject's foot to be easily inserted into the footwear 2 and withdrawn therefrom. The vamp's heel portion 9 is strengthened by way of a heel patch 11 whilst a flap 12 with Velcro-type hook fasteners 13 for mating with Velcro-type loop fasteners 14 on the right hand vamp half 7 (see FIGS. 3 and 4) is provided for fastening the footwear 2 on a subject's foot when accommodated therein.

Figure 4:
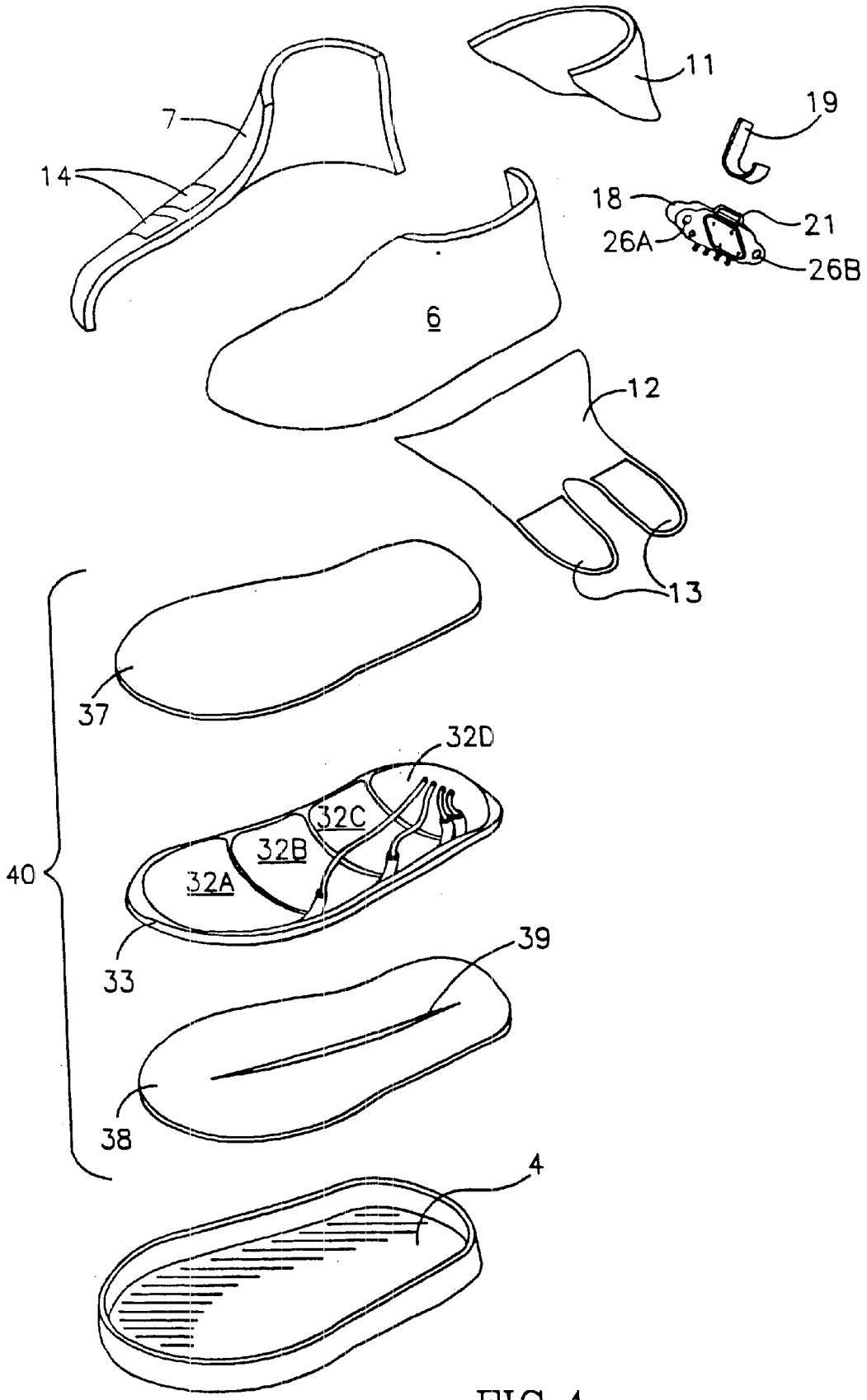
FIG. 4 is an exploded view of the boot-like footwear of FIG. 1.

The flap 12 defines a generally triangular shaped pocket 16 having an aperture 17 adjacent an externally accessible connector member 18 secured to the left hand vamp half 6 towards the footwear's heel portion 9 by way of a tab 19 engaging a buckle-like member 21 provided along one side of the connector member 18 (see FIG. 4). The connector member 18 is adapted for selective connection to a complementary connector member 22 in permanent fluid communication with a pressure source 23 under the control of a controller 24. The connector members 18 and 22 are of the quick release self alignment magnetically latched type and have a first pair of magnets 26A and 26B at one end thereof and a second pair of magnets 27A and 27B at the other end of thereof. The pairs of magnets 26A, 26B and 27A, 27B are polarized such that the connector member 22 can only be attached to the connector member 18 in a single predetermined manner.

The pressure source 24 has four outlet ports 28A–28D which are in fluid communication with four ports 29A–29D on the upstream side of the connector member 22 which, on connection of the connector member 22 to the connector member 18, are in turn in fluid communication with four ports 31A–31D on the downstream side of the connector member 18 which are in turn in fluid communication with four inflatable bladders 32A–32D for independently inflating and deflating the inflatable bladders 32A–32D in accordance with a pre-determined heel-to-toe or toe-to-heel sequence.

The inflatable bladders 32A–32D are adhered to the top side of a platform 33 and are staggered therealong in a non-overlapping fashion for applying pressure to the underside of a foot's toes, metatarsal region, plantar region, and heel, respectively. The inflatable bladders 32A–32D have laterally extending neck portions 34A–34D directed toward the left hand vamp half 6. The neck portions 34A–34D have apertures 35A–35D which are raised relative to the platform 33 and are connected to the four to 31A–31D via plastic tubes 36A–36D which extend between the juncture between the left hand vamp half 6 and the sole 4, and through the pocket 16 to the connector member 18. In this manner, the tubes 36A–36D are normally concealed from view and are so disposed that their presence is not felt by a subject when walking which would otherwise cause him some discomfort.

The platform 33 is interdisposed between a relatively pliable upper sole member 37 and a more rigid lower sole member 38 of an inner sole construction 39 which is in turn interdisposed between the vamp 3 and the sole 4. The upper sole member 37 is peripherally attached to the vamp 3 and he lower sole member 38 is peripherally attached to an underside of the upper sole member 37 and is initially provided with a lengthwise extending slit 39 through which the platform 33 is inserted into a receiving pocket 41 defined between the upper and lower sole members 37 and 38 (see FIG. 3).

The footwear 2 looks like conventional boot-like slippers except for the connector member 18 which is unobtrusively disposed on its innermost surface and can be worn instead of them. A subject can readily attach the connector member 18 to the connector member 22 by merely bringing the latter into proximity with the former whereupon the pairs of magnets 26 and 27 effect a tight sealing connection therebetween for undergoing treatment. After the treatment, the connector member 22 can be readily detached from the connector member 18 by displacing his foot away from the former.

Figure 5:
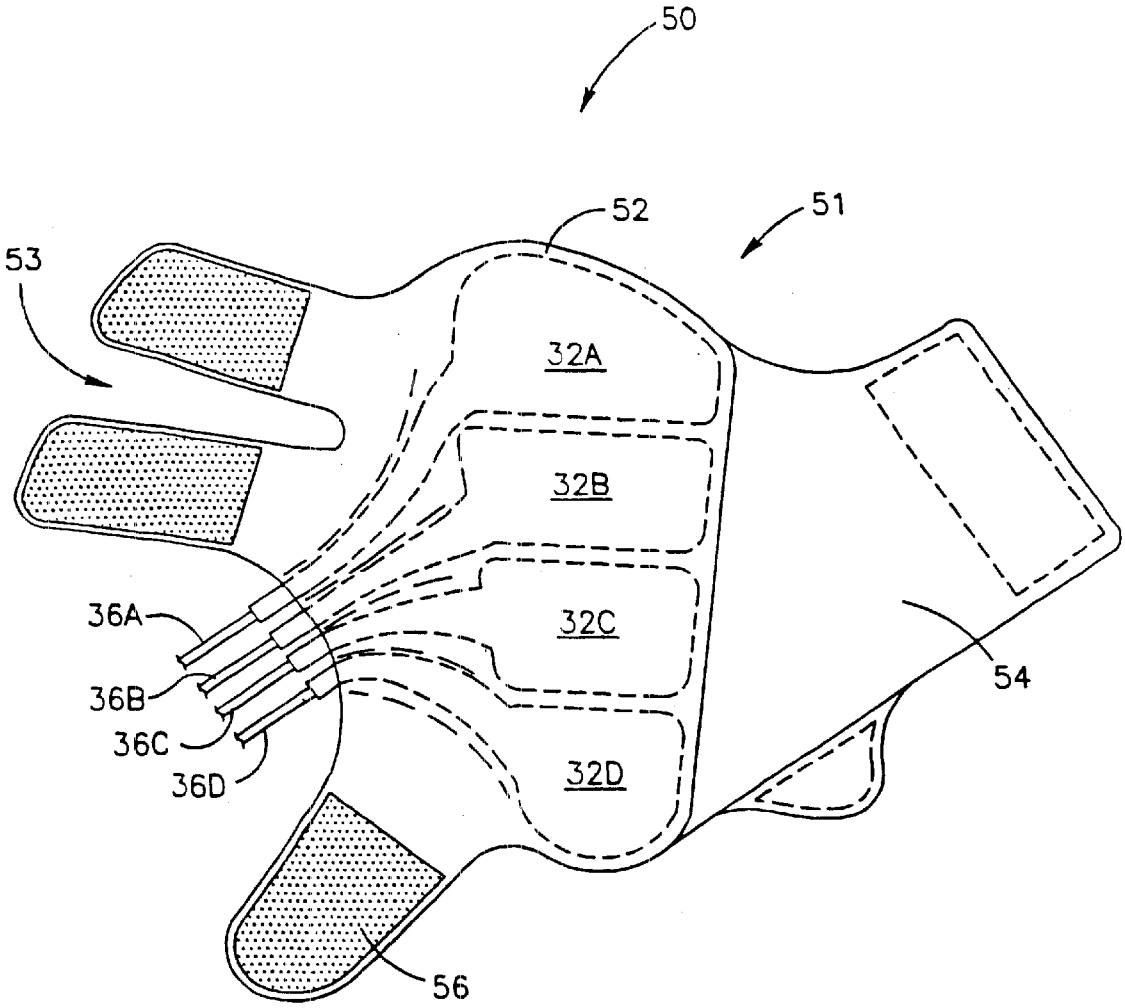
FIG. 5 is a top view of a medical device implemented as a normally flat, one-piece, foldable wrap for accommodating a subject's foot.
Figure 6:
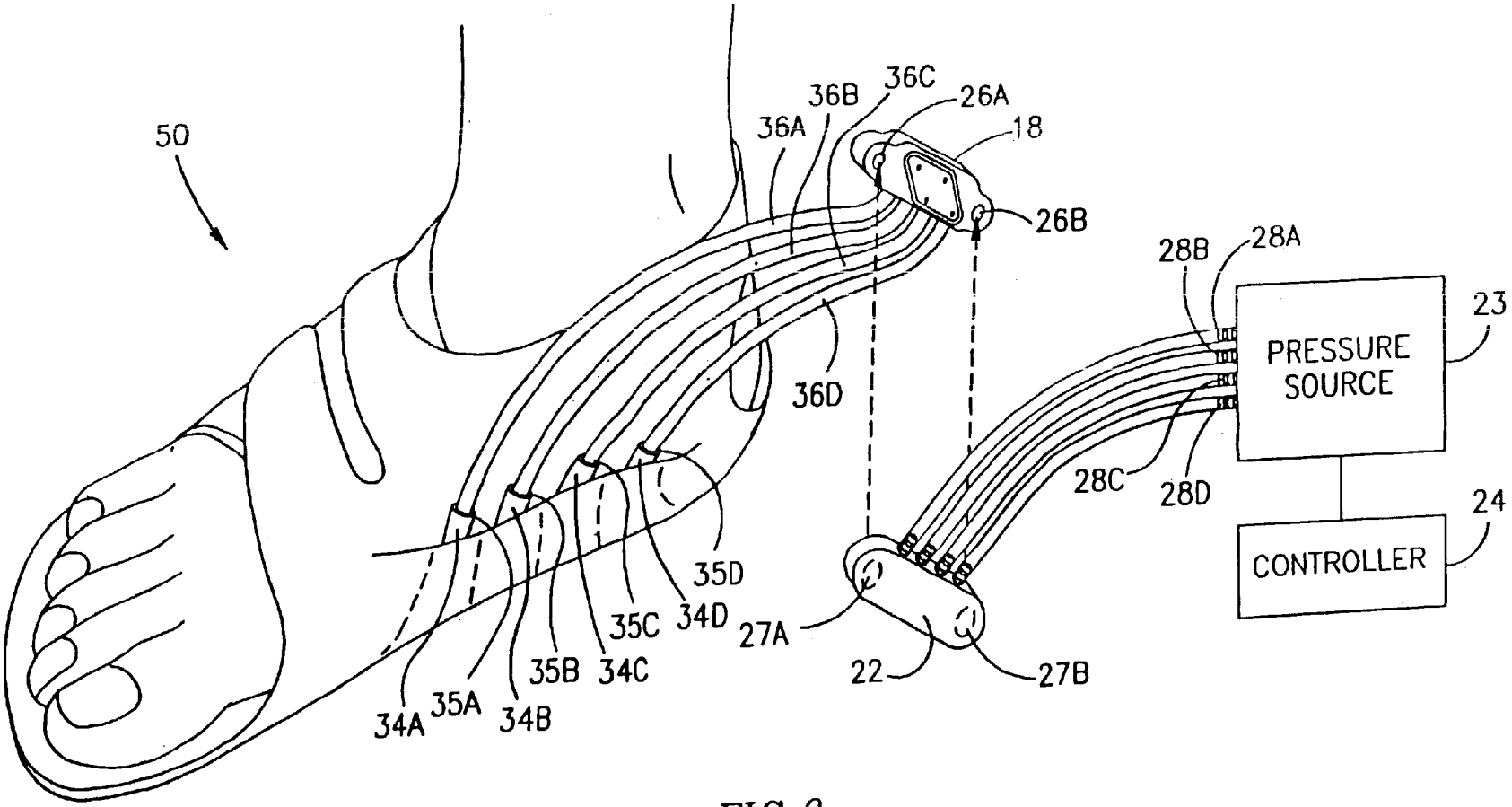
FIG. 6 is a pictorial view of the foldable wrap of FIG. 5 accommodating a subject's foot.

With reference now to FIGS. 5 and 6, a medical device 50 is similar to the medical device 1 except that it is implemented as a normally flat, one-piece, foldable wrap 51 having a central portion 52 supporting the platform 33, left and right vamp portions 53 and 54, and a heel restraining member 56. The medical device 50 has the same platform 33 with the four inflatable bladders 32A–32D disposed thereon, the inflatable bladders 32A–32D converging towards neck portions 34A–34D with apertures 35A–35D which in this case are raised above the platform 33 when the wrap 51 is wrapped around a subject's foot to accommodate same. The apertures 35A–35D are fitted with tubes 36A–36D in fluid communication with the connector member 18 for connection to the pressure source 23. The wrap 51 is normally employed for long treatment periods, for example, when a subject is sleeping, however, by virtue of the arrangement of tubes 36A–36D, a subject having his feet accommodated in wraps 51 can stand up without feeling any discomfort.

Figure 2:
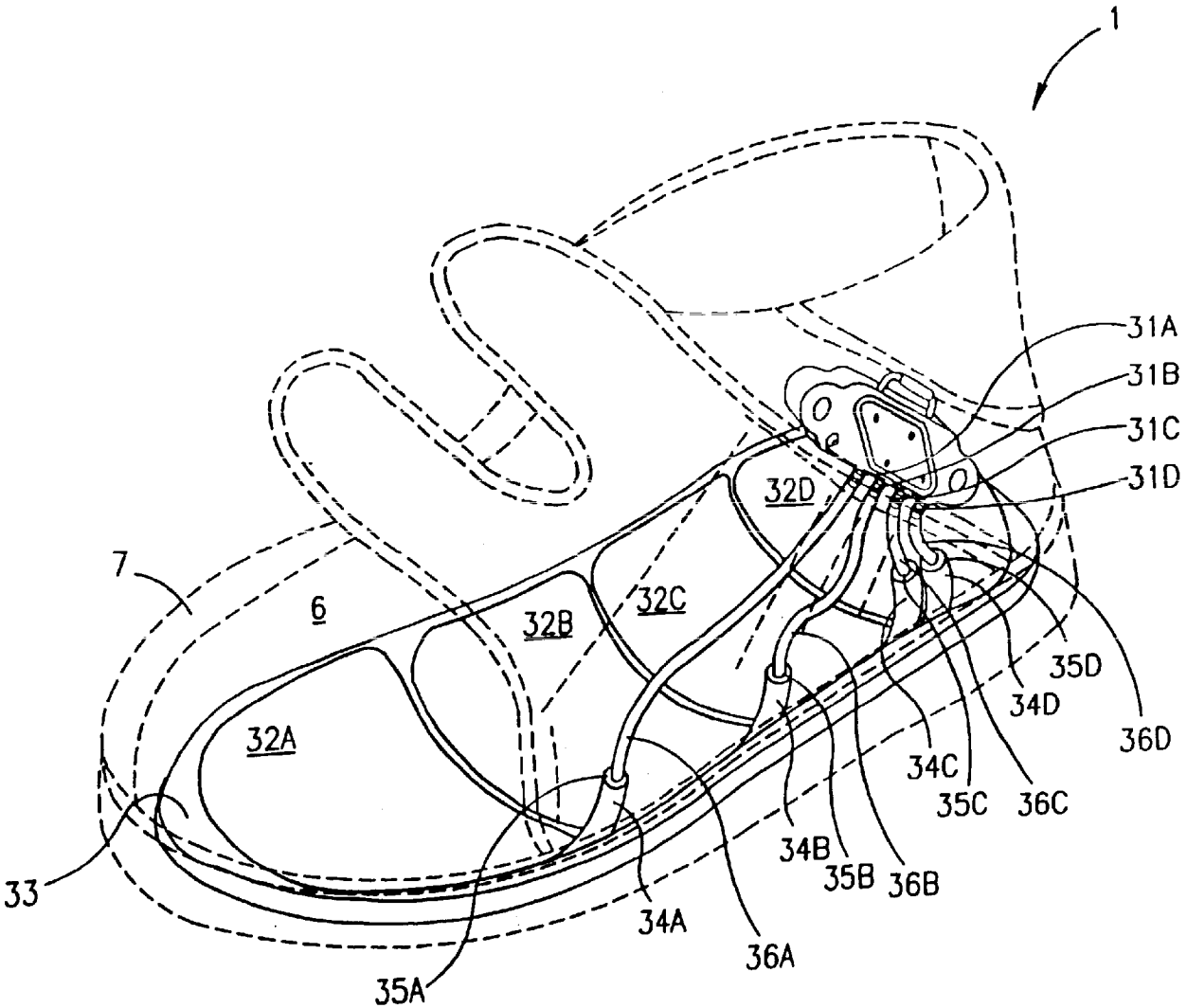
FIG. 2 is a transparent pictorial view of the boot-like footwear of FIG. 1.
Figure 3:
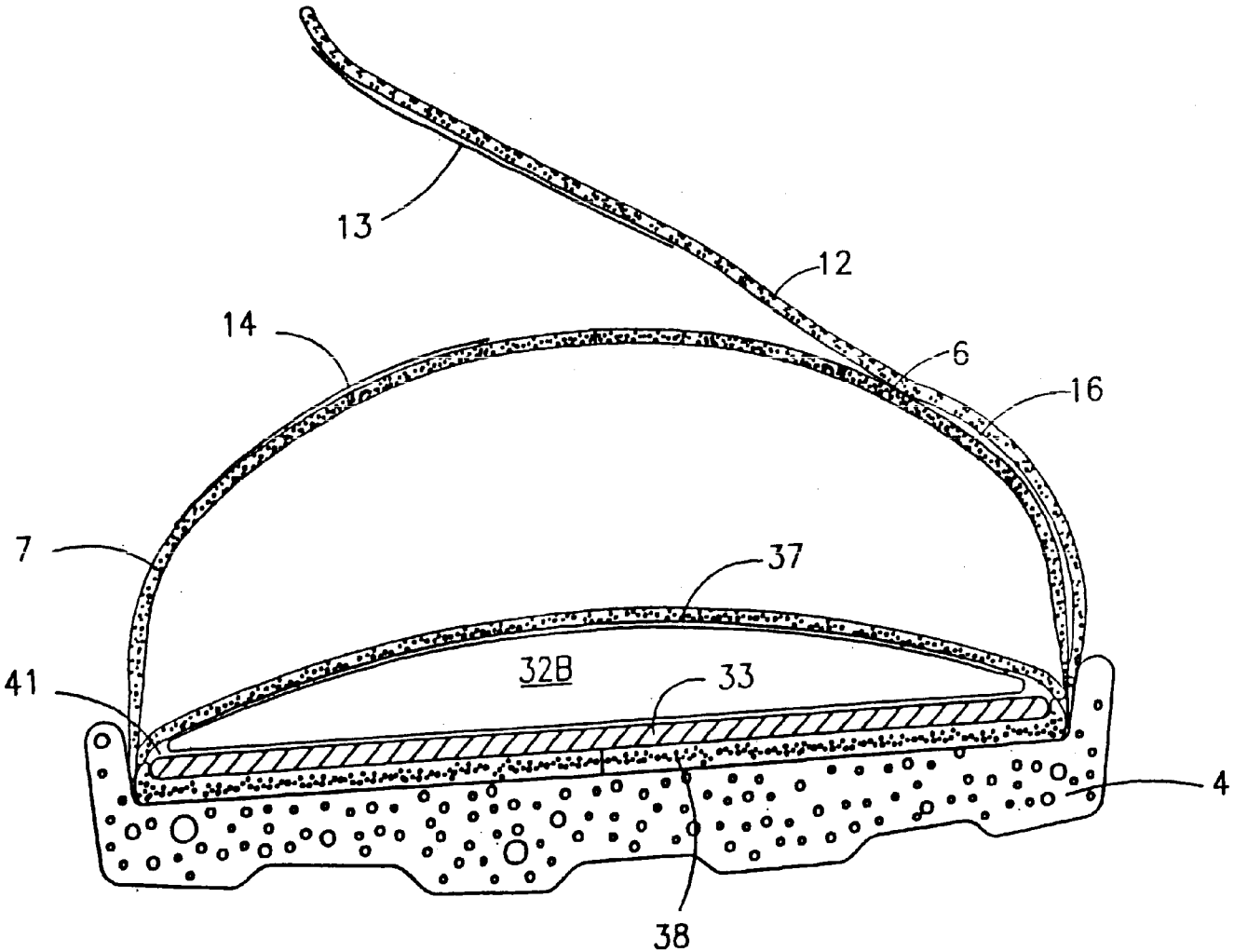
FIG. 3 is a transverse cross sectional view of the footwear of FIG. 1 along line III—III in FIG. 1 with an inflated inflatable bladder for applying pressure to a foot's metatarsal region.
Figure 17A:
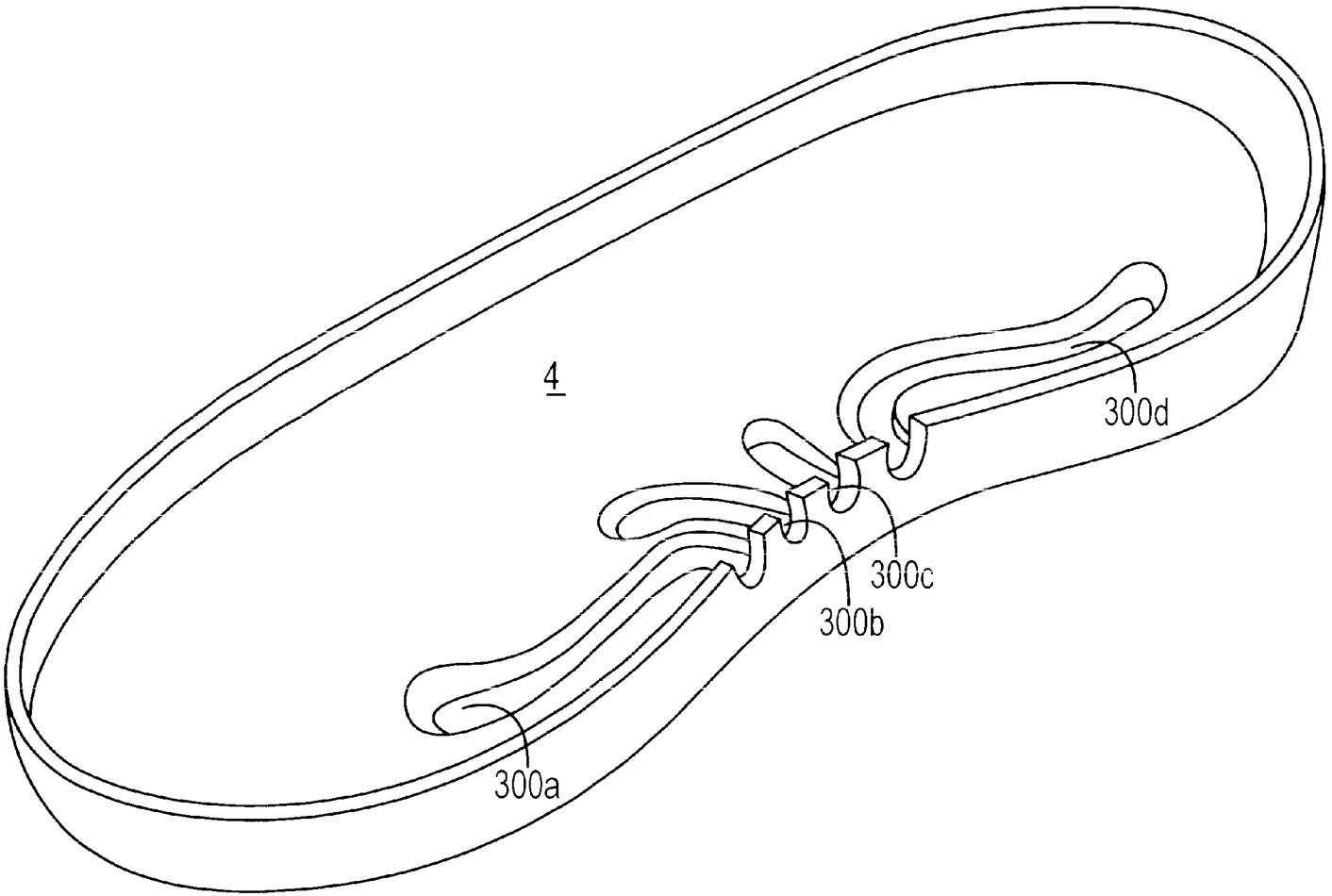
FIGS. 17*a* and 17*b* are perspective views of a second embodiment of the sole.
Figure 17B:
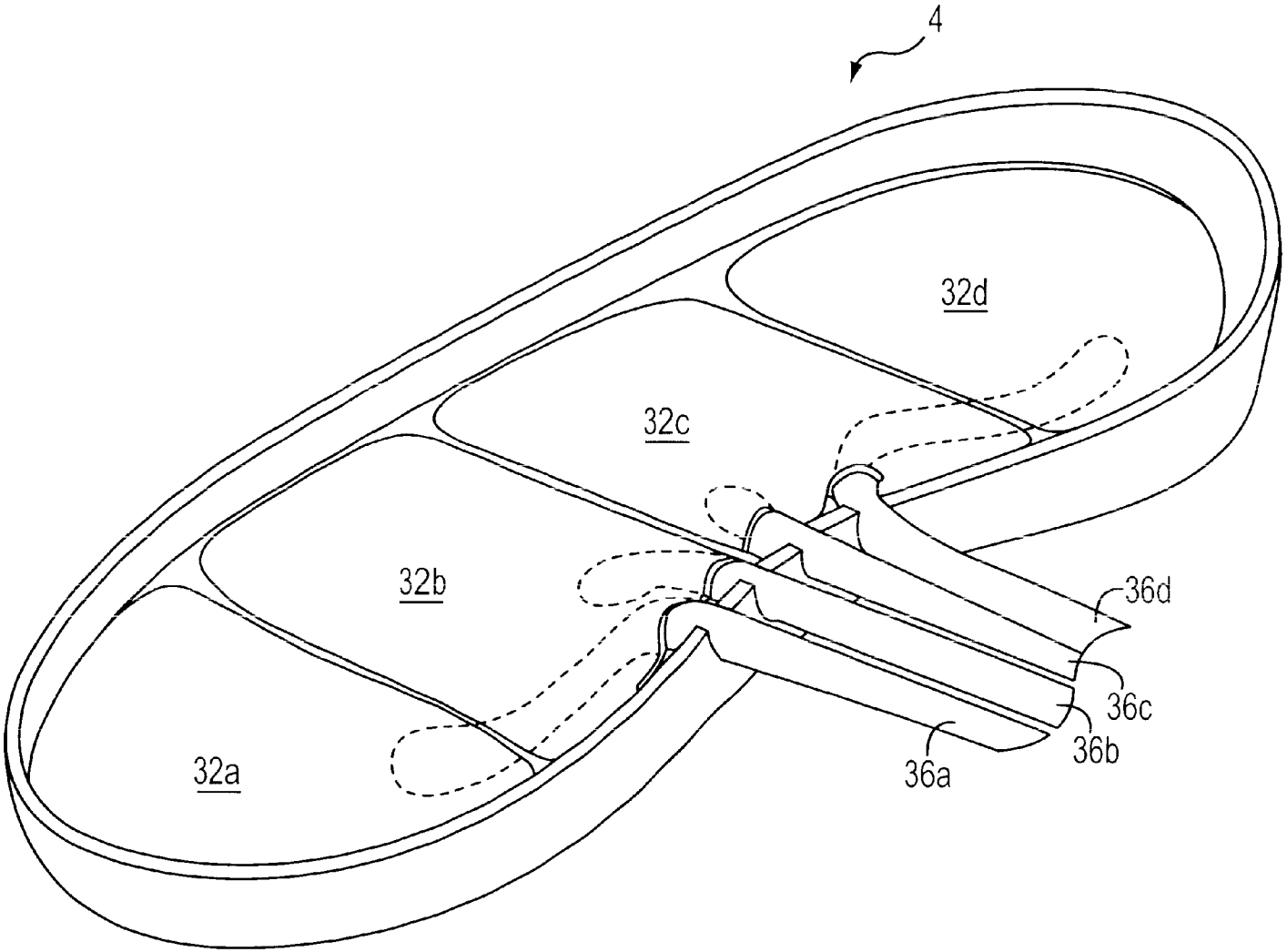

In accordance with the present invention, sole 4 may be embodied with varying configurations of recessed channels for guiding tubular elements 36*a*, 36*b*, 36*c*, and 36*d* to inflatable chambers 32*a*, 32*b*, 32*c*, and 32*d*. With reference to FIGS. 17A and 17B, the figures depict one embodiment of sole 4 with channels 300*a*, 300*b*, 300*c*, and 300*d* that permit tubular elements 36*a*, 36*b*, 36*c*, and 36*d* to be introduced from the side. The difference between this embodiment and the previous embodiment of FIGS. 2, 5, and 6 is that introduction of tubular elements 36*a*, 36*b*, 36*c*, and 36*d* are congregated in this embodiment, whereas introduction of tubular elements 36*a*, 36*b*, 36*c*, and 36*d* span the entire side of sole 4 in the previous embodiment.

Figures 18A, 18B:
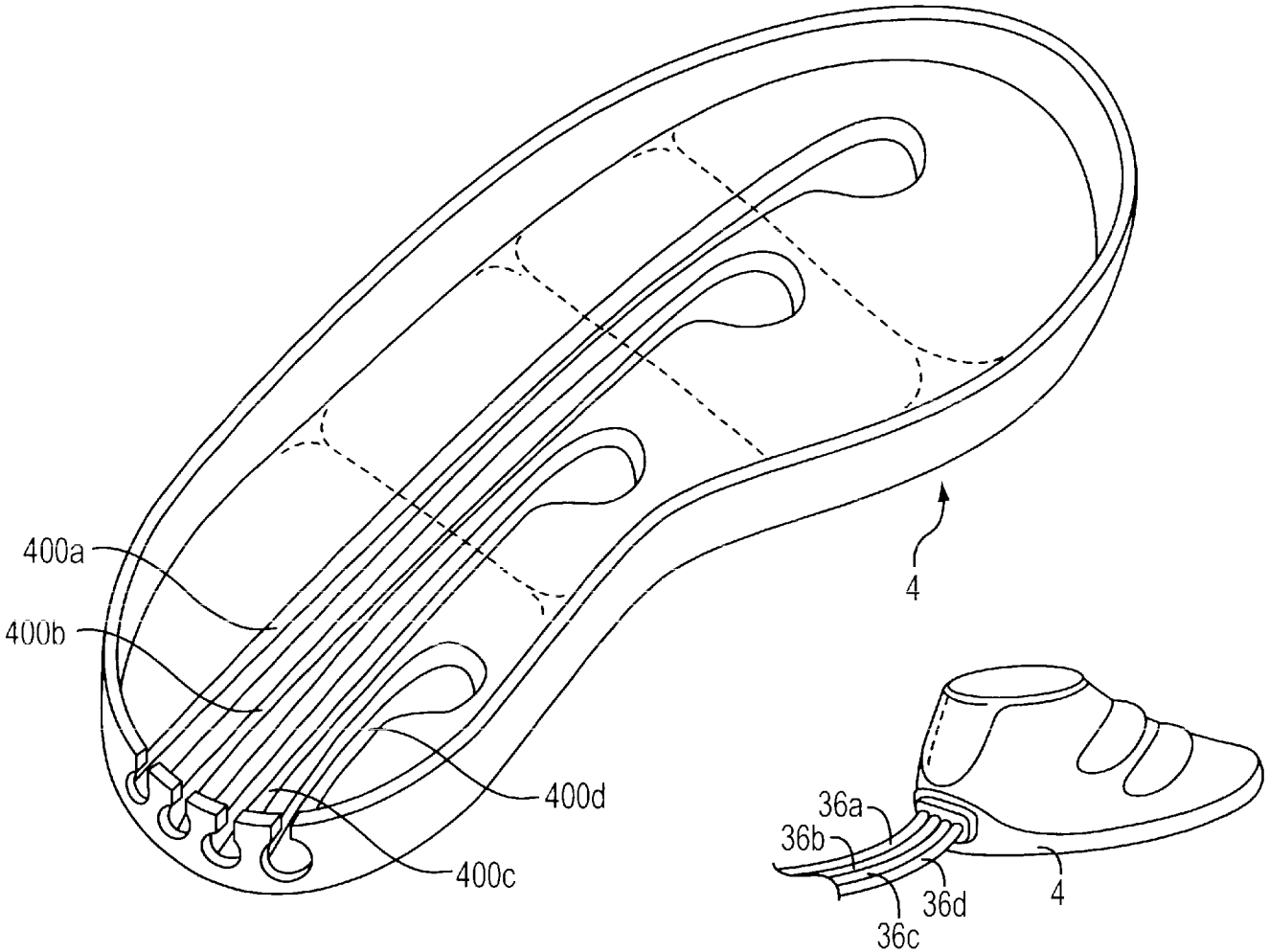
FIGS. 18*a* and 18*b* are perspective views of a third embodiment of the sole.

FIGS. 18A and 18B illustrate another embodiment of sole 4 with recessed channels 400*a*, 400*b*, 400*c*, and 400*d* that permit tubular elements 36*a*, 36*b*, 36*c*, and 36*d* to be introduced from the rear.

Figures 19A, 19B:
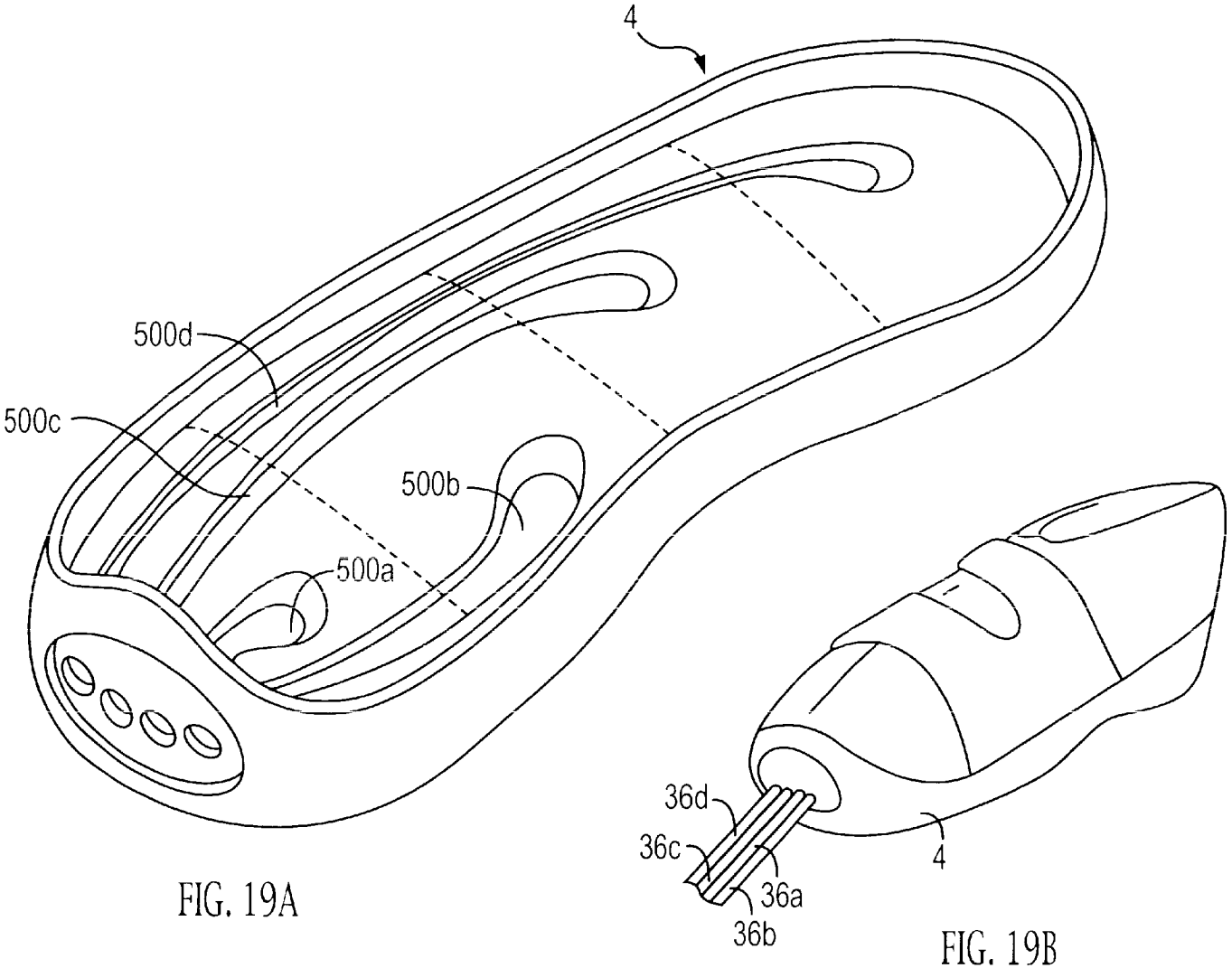
FIGS. 19*a* and 19*b* are perspective views of a fourth embodiment of the sole.

FIGS. 19A and 19B show yet another embodiment in which channels 500*a*, 500*b*, 500*c*, and 500*d* permit tubular elements 36*a*, 36*b*, 36*c*, and 36*d* to enter from the front of sole 4.

Figure 20A:
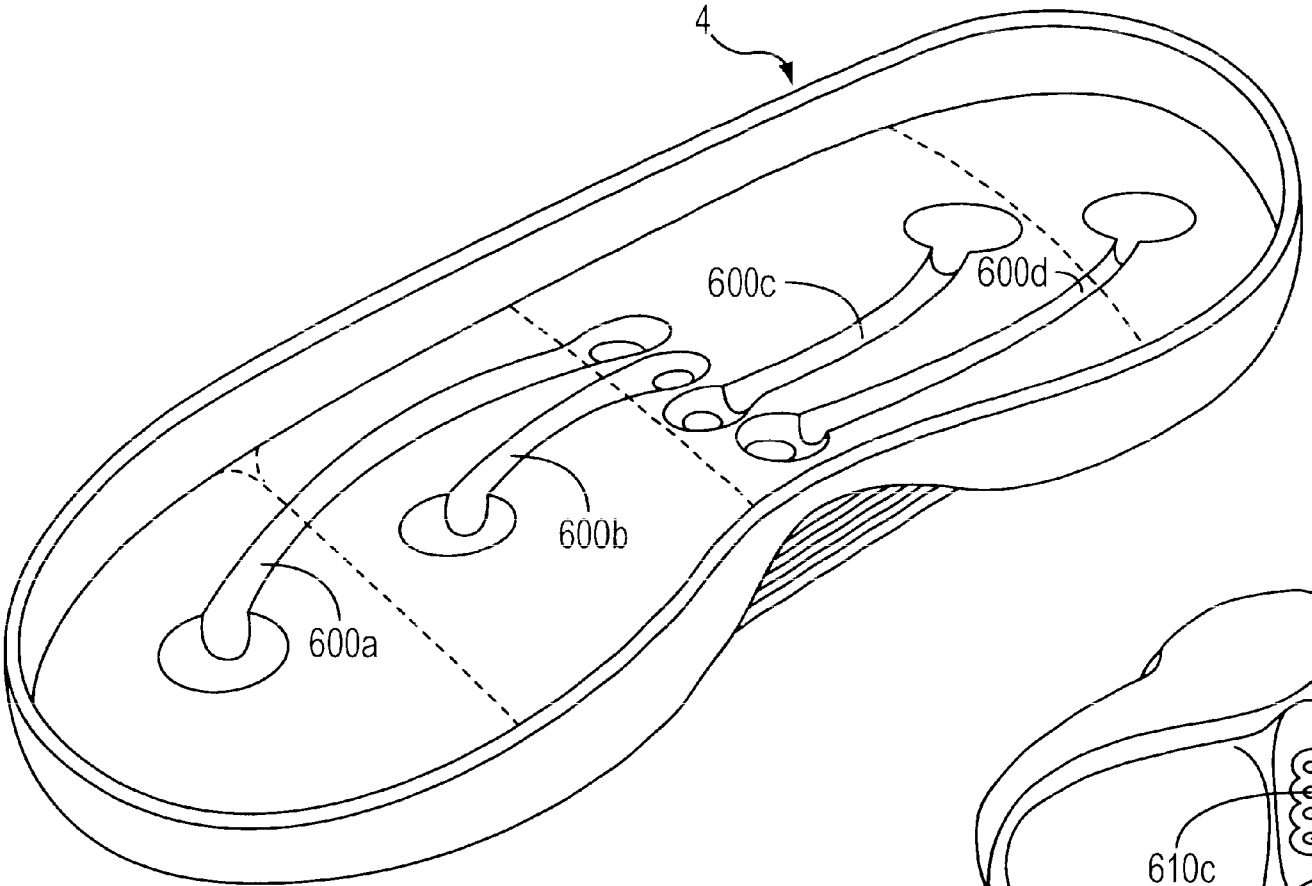
FIGS. 20*a* and 20*b* are perspective views of a fifth embodiment of the sole.
Figure 20B:
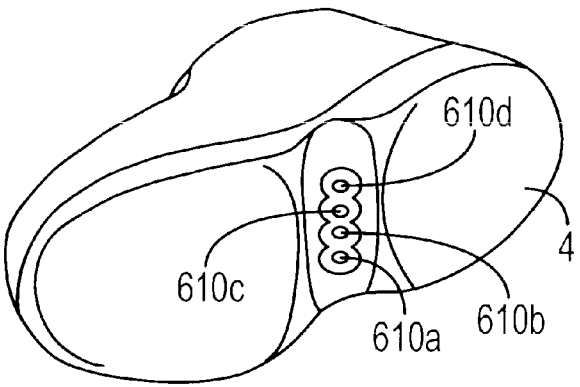

A final embodiment depicted in FIGS. 20A and 20B comprises channels 600*a*, 600*b*, 600*c*, and 600*d* that are configured to allow tubular elements 36*a*, 36*b*, 36*c*, and 36*d* to enter through the underside of sole 4 via holes 610*a*, 610*b*, 610*c*, and 610*d*. Of course, one of ordinary skill in the art will recognize that neck portions 34*a–d* and apertures 35*a–d* may need to be repositioned to accommodate the changes in location of the channel entrances in the embodiments of FIGS. 1720.

Figure 7:
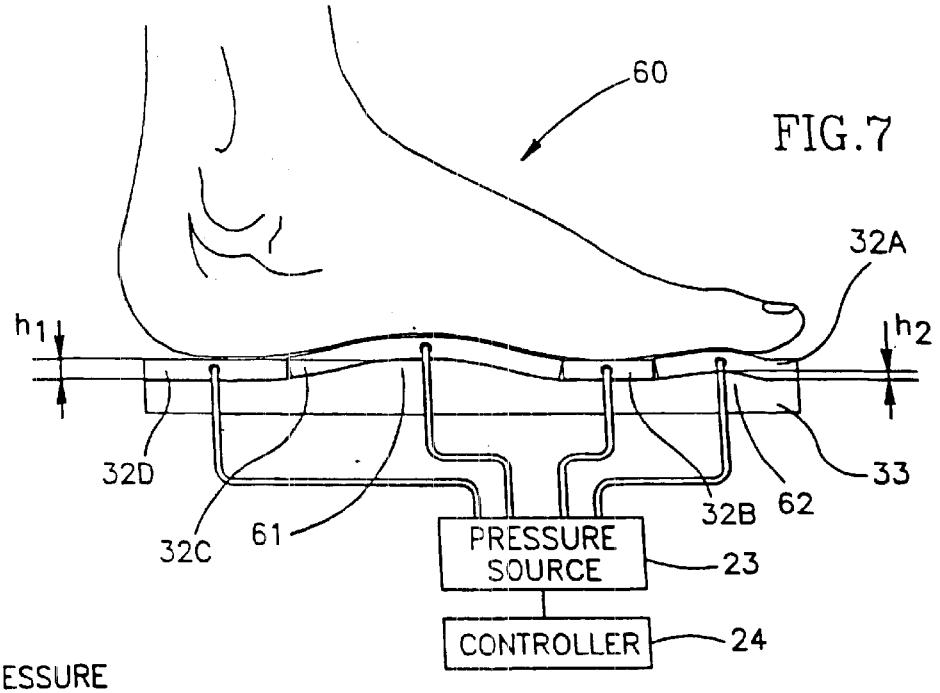
FIG. 7 is a schematic side view of the medical devices of FIGS. 1 and 5 showing modifications thereof.

With reference now to FIG. 7, a medical device 60 is similar to the medical device 10 and differs therefrom in that its platform 33 is formed with an arched plantar arch support 61 of height $h_1$ for permanently supporting the foot's plantar arch and an arched toe arch support 62 of height $h_2$ for permanently supporting the foot's toes at their base. The support 61 typically has a maximum height above the platform 33 of between about 0.7 cm and 1.2 cm and preferably about 1.0 cm whilst the support 62 typically has a maximum height of between about 0.3 cm and 0.7 cm and preferably 0.5 cm above the platform 33. The supports 61 and 62 provide a number of advantages including affording a more comfortable fit in a similar manner to orthopedic inner soles, facilitating the need for a smaller pressure source 23, and for enabling a more rapid attainment of a predetermined pressure in their associated inflatable bladders 32C and 32A.

Figure 8:
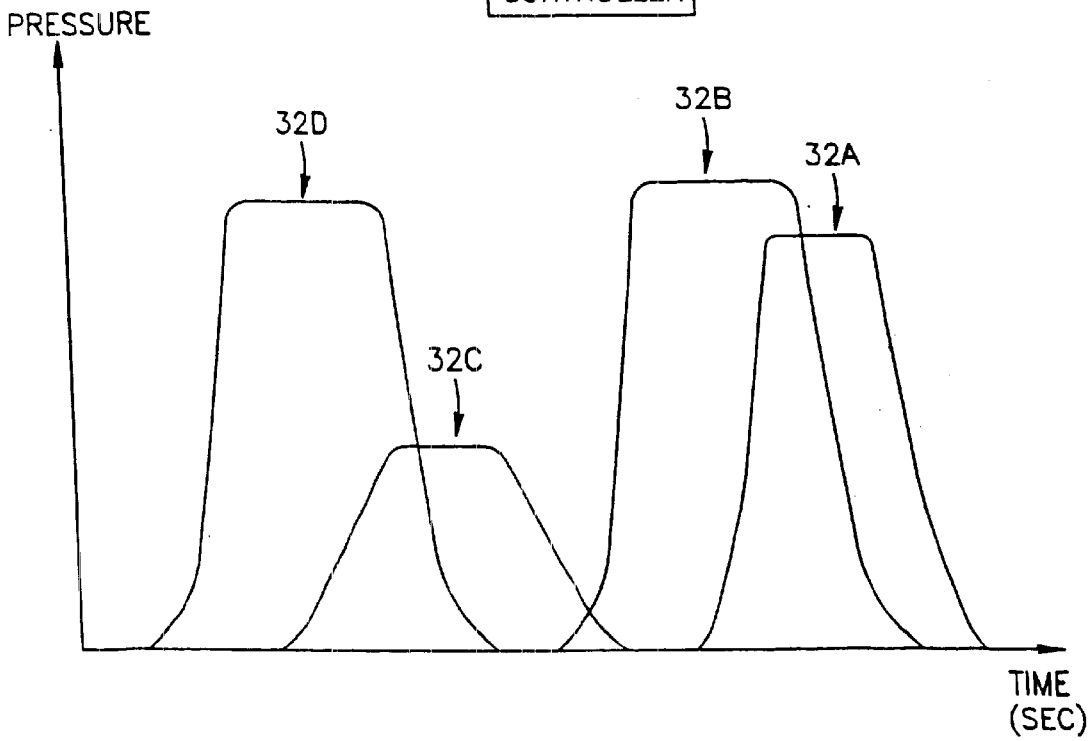
FIG. 8 is a graph showing a heel-to-toe inflation sequence of the inflatable bladders of the medical devices of FIGS. 1 and 5.

With reference now to FIG. 8, the chart shows a heel-to-toe sequence for inflating and deflating the inflatable bladders 32A–32D which in contradistinction to the conventional distal to proximal direction of a traveling compression wave for effecting venous blood return. The heel-to-toe sequence in effect mimics a subject's walking for naturally stimulating his calf's venous muscular pump and his foot's venous plexus.

As discussed hereinabove, blood circulation in the legs is dependent on activation of motorical mechanisms. Activities such as standing "actuate" passive motorical mechanisms such as compression of the venous plexus, resulting in emptying of the blood within the venous plexus into the deep veins of the foot and calf. Activities such as walking and running actuate active motorical mechanisms such as the venous muscular pumps. Activation of the venous muscular pumps result in sequential compression of the deep veins within the calf, thereby forcing venous blood within the deep veins upstream toward the heart. Thus, the active mechanism triggered by the muscular venous pump is complementary to the passive mechanism triggered by emptying of the venous plexus of the foot, propelling blood previously forced into the calf by compression of the venous plexus toward the heart.

Figure 9:
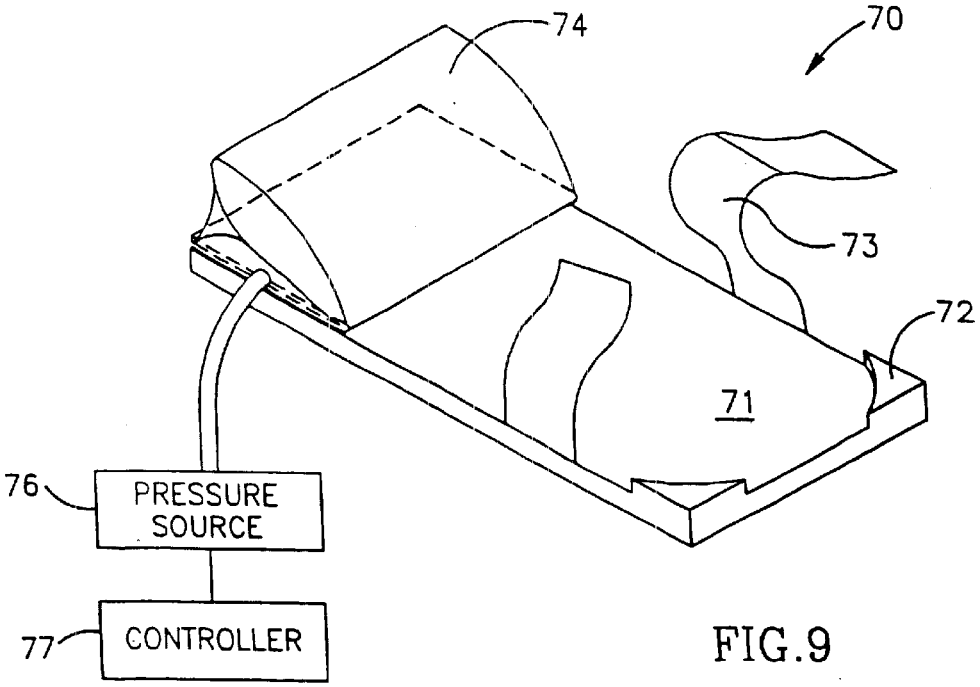
FIG. 9 is a pictorial view of a medical device for dorsiflexion of a subject's foot.
Figure 10:
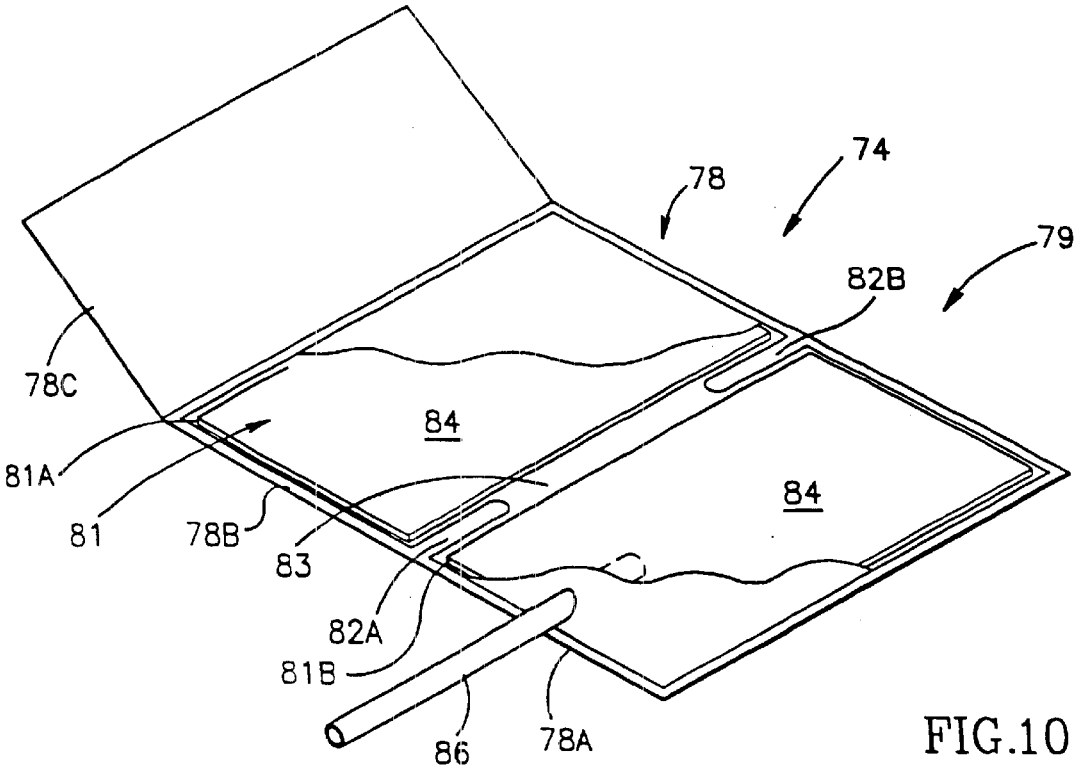
FIG. 10 is a perspective view of the inflatable bladder of the medical device of FIG. 9.
Figure 11A:
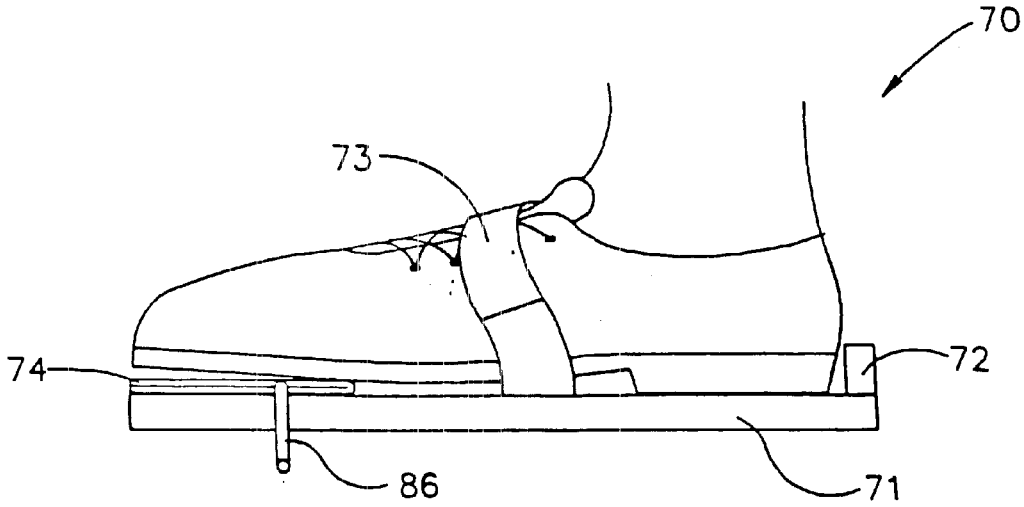
FIGS. 11A and 11B are side views of the medical device of FIG. 9 during operation.
Figure 11B:
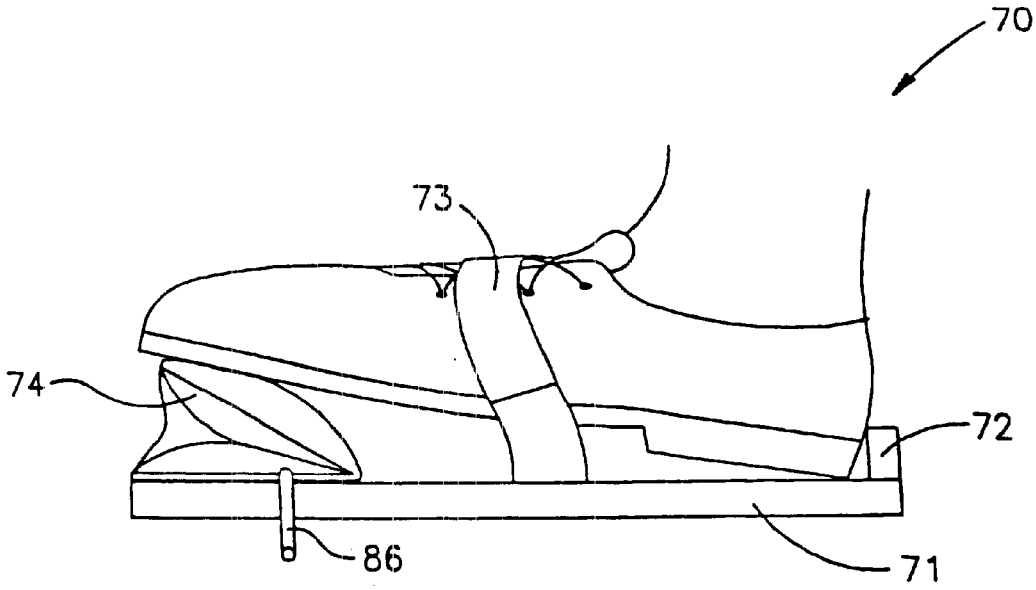

With reference now to FIGS. 9–11, a medical device 70 for effecting dorsiflexion of a subject's foot includes a platform 71 with a heel support 72, a foot strap 73 and an inflatable bladder 74. The inflatable bladder 74 is disposed at one end of the platform 71 for solely underlying a foot's front portion, and is connected to a pressure source 76 under the control of a controller 77 for cyclically inflating it from a generally flat configuration (see FIG. 11A) to a wedge shaped configuration (see FIG. 11B) tapering toward the platform's other end.

The inflatable bladder 74 includes a three section cover 78 having sections 78A, 78B and 78C, the former two being formed as a pouch 79 for receiving a generally square single inflatable cell 81 whilst the latter one is a restraining member for limiting the maximum height of the inflated wedge shape. The inflatable cell 81 is divided into two equal sized compartments 81A and 81B by two seams 82A and 82B lateral of a central portion 83 enabling fluid communication between the compartments 81A and 81B. Each compartment 81A and 81B has a rigid member 84 lying thereatop, and the compartment 81B is provided with an inlet port 86 which also serves to inflate the other compartment 81A.

Figure 12:
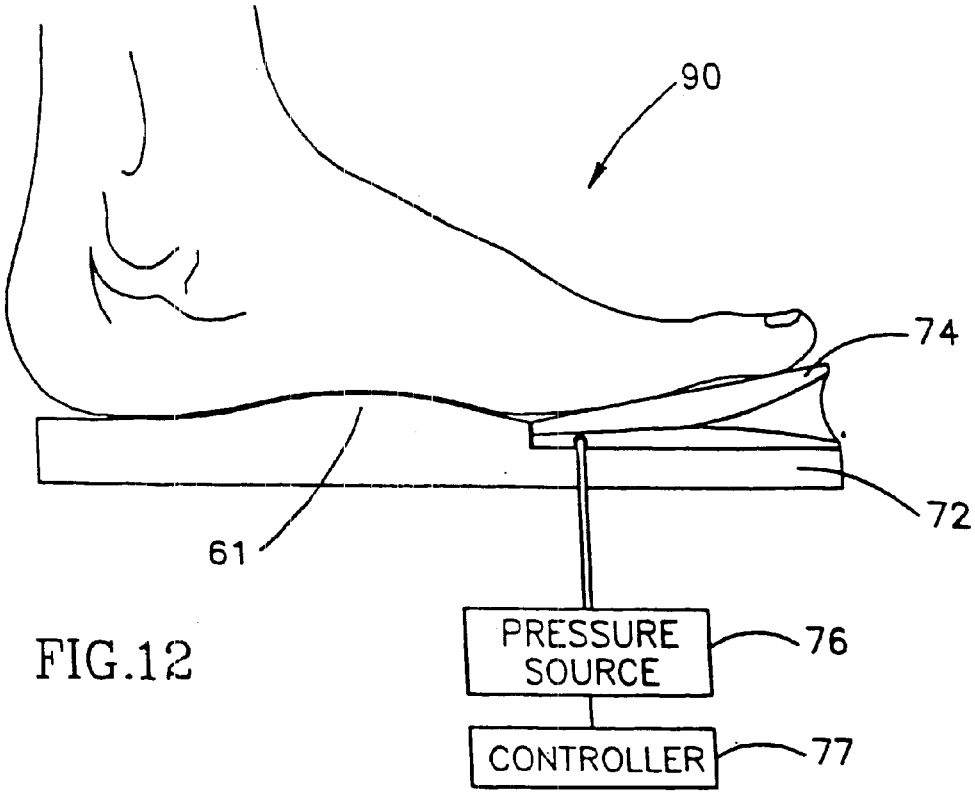
FIG. 12 is a schematic side view of an alternative medical device for dorsiflexion of a subject's bare foot.

With reference now to FIG. 12, a medical device 90 is similar to the medical device 70 and also includes the arched plantar arch support 61 for effecting a cyclic dorsiflexion of a subject's foot combined with a rocking motion about the plantar arch support 61.

Figure 13:
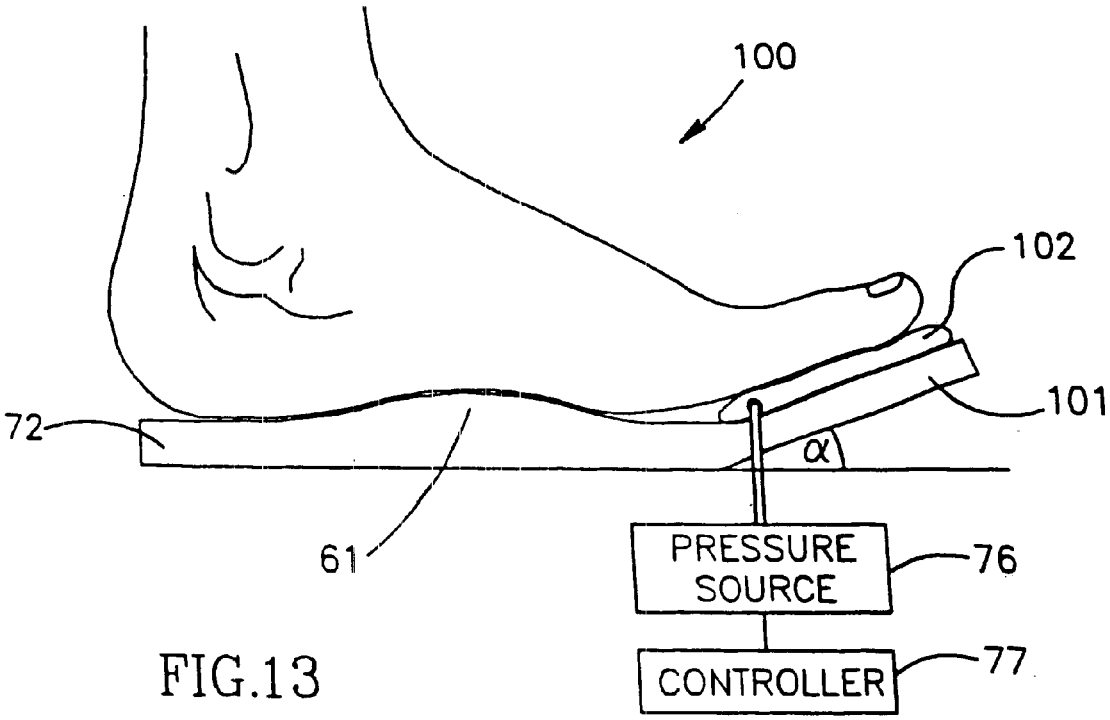
FIG. 13 is a schematic side view of another alternative medical device for effecting dorsiflexion of a subject's bare foot.

With reference now to FIG. 13, a medical device 1000 is similar to medical device 90 and also includes a wedge shaped support 101 tapering towards a foot's heel for permanently supporting a foot's front portion in a flexed position relative to the foot's remaining portion overlying the platform 72, thereby facilitating better dorsiflexion which occurs with a more flexed position of a foot's front portion. The support 101 subtends an included angle a of about 300 relative to the platform 72, and has a simple inflatable member 102 disposed thereon for effecting cyclic dorsiflexion of the subject's foot combined with a rocking motion about the plantar arch support 61.

Figure 14A:
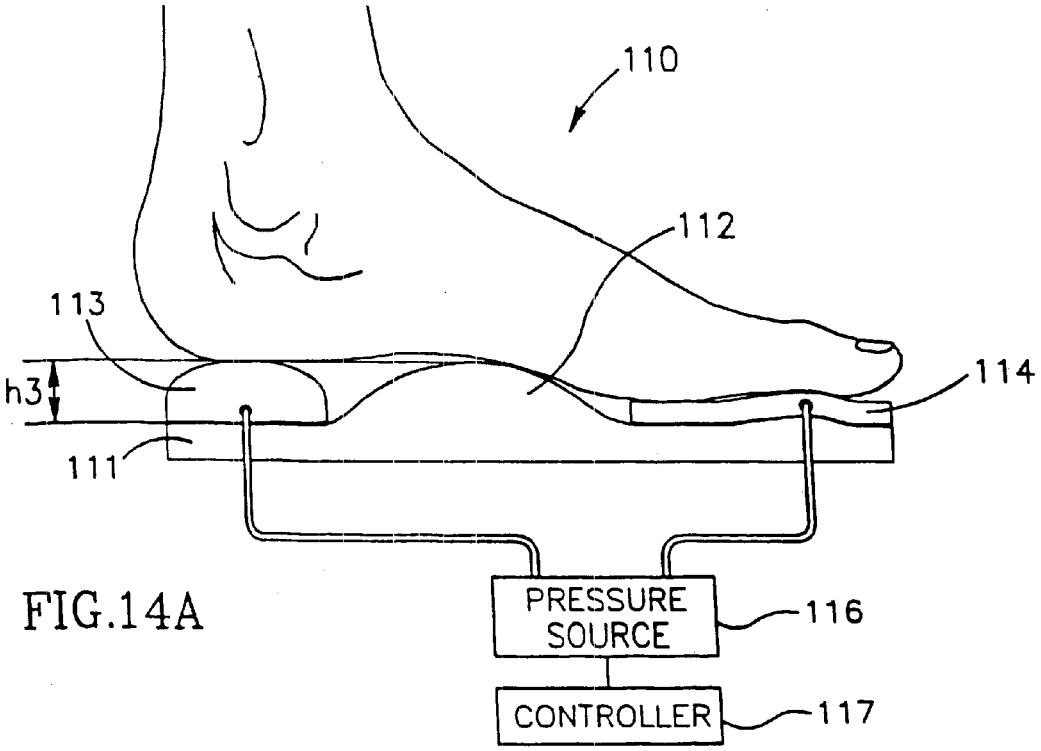
FIGS. 14A and 14B are schematic side views of a medical device for effecting a rocking motion of a subject's foot about a plantar arch support.
Figure 14B:
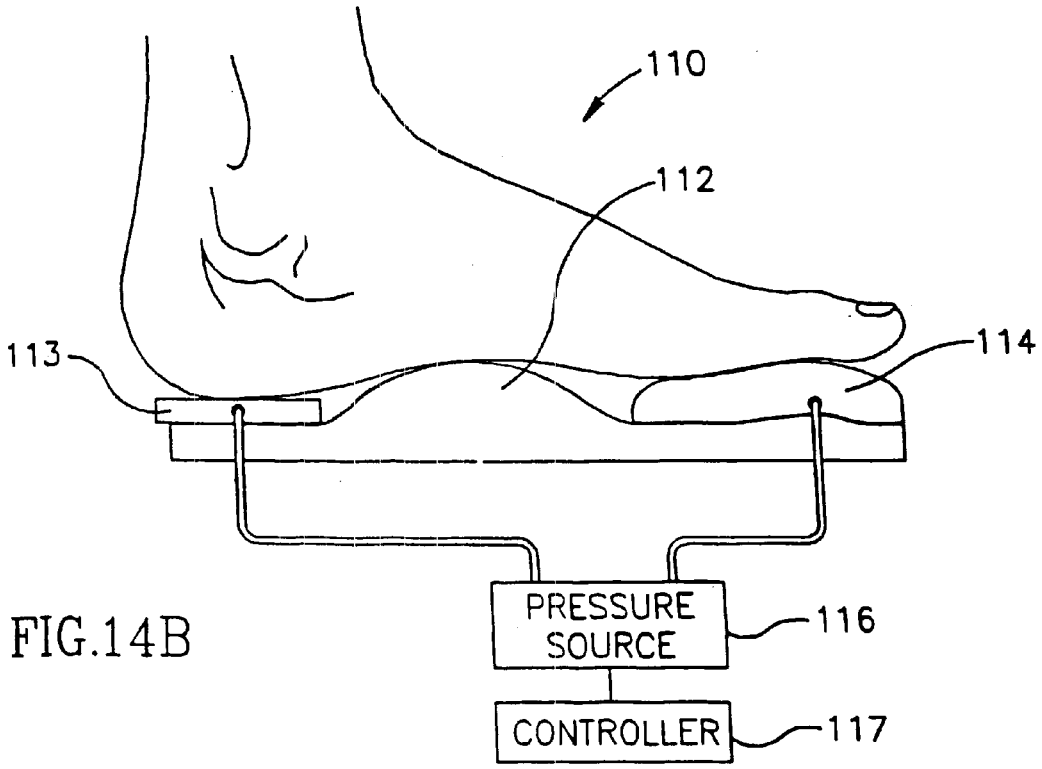

With reference now to FIGS. 14A and 14B, a medical device 110 has a platform 111 with an arched plantar arch support 112 and a pair of inflatable bladders 13 and 114 disposed lateral thereto and in fluid communication with a pressure source 116 under the control of a controller 117 for effecting a rocking motion of a subject's foot about the plantar arch support 112 by way of the cyclic alternate actuation of the inflation bladders 113 and 114 for respectively elevating the foot's heel relative to the platform 11 whilst the foot's front portion is thereatop and elevating the foot's front portion relative to the platform 111 whilst the foot's heel is thereatop, thereby effectively rendering dorsiplantar flexion of the subject's foot for facilitation emptying of the foot's venous plexus and activating his calf's venous muscular pump to pump venous blood from the subject's foot and leg towards his heart. The support 112 typically has a maximum height $h_3$ above the platform 111 of between about 1 cm and about 3 cm and preferably about 2 cm.

Figure 15:
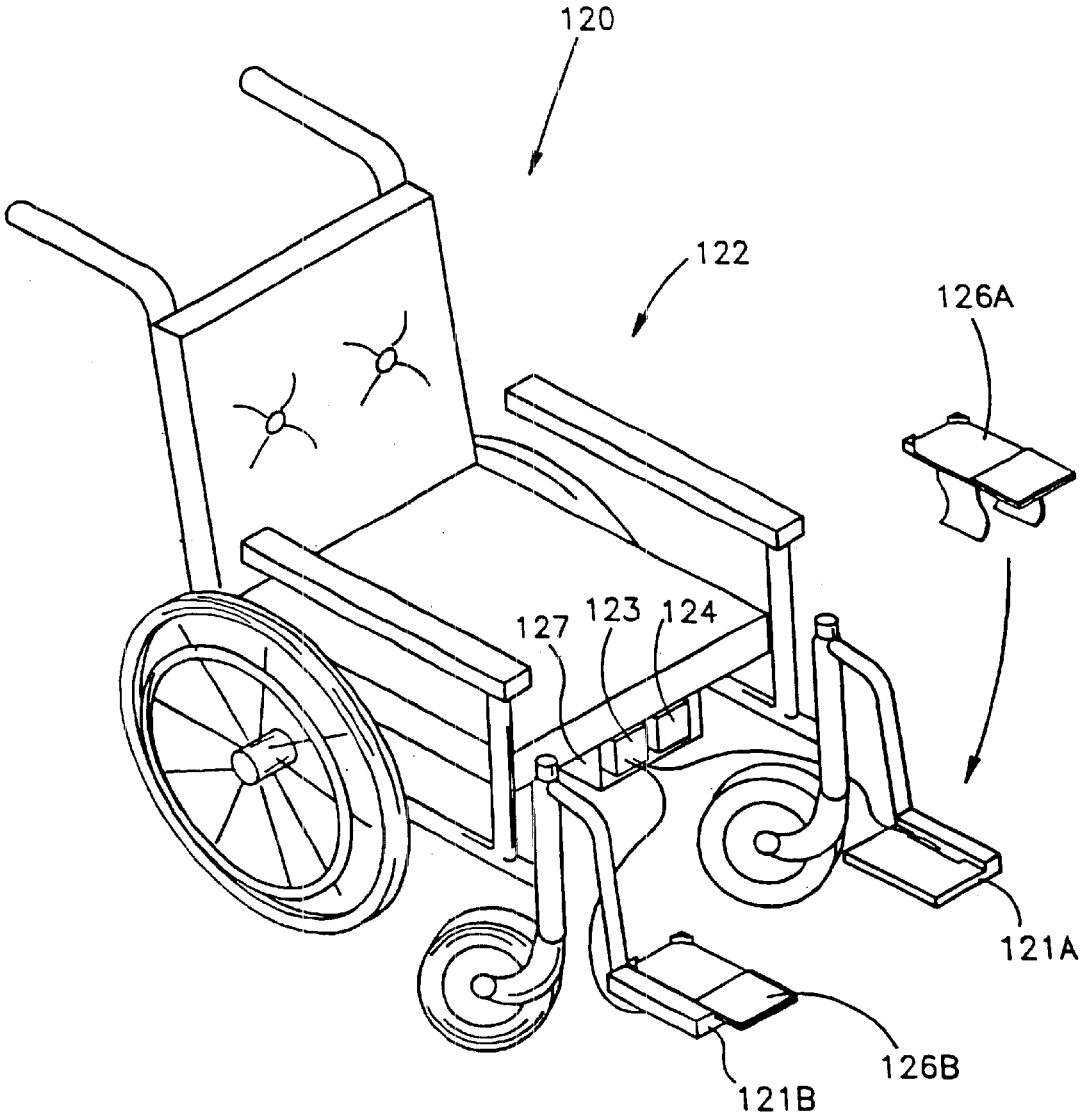
FIG. 15 is a pictorial view of a wheelchair fitted with a kit for effecting dorsiflexion of a wheelchair-bound subject's feet.

With reference to FIG. 15, a wheelchair 120 having left and right foot supports 121A and 121B is fitted with a medical system 122 for effecting dorsiflexion of a wheelchair bound subject's feet. The medical system 122 includes a rechargeable battery operated compressor 123, a controller 123 and two medical devices 126A and 126B. The compressor 123 and the controller 124 are carried on a rack 127 and the medical devices 126A and 126B are respectively mounted on the wheelchair's foot supports 121A and 121B whereby the medical system 122 is fully portable and therefore does not preclude the subject from continuing his everyday activities.

Figure 16A:
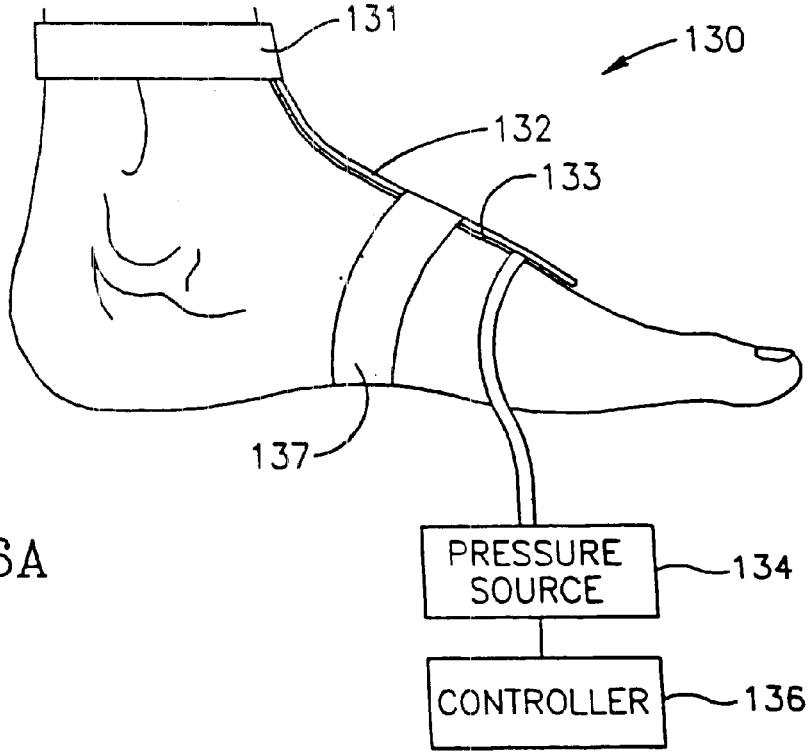
FIGS. 16A and 16B are side views of a medical device for effecting plantar flexion of a subject's foot.
Figure 16B:
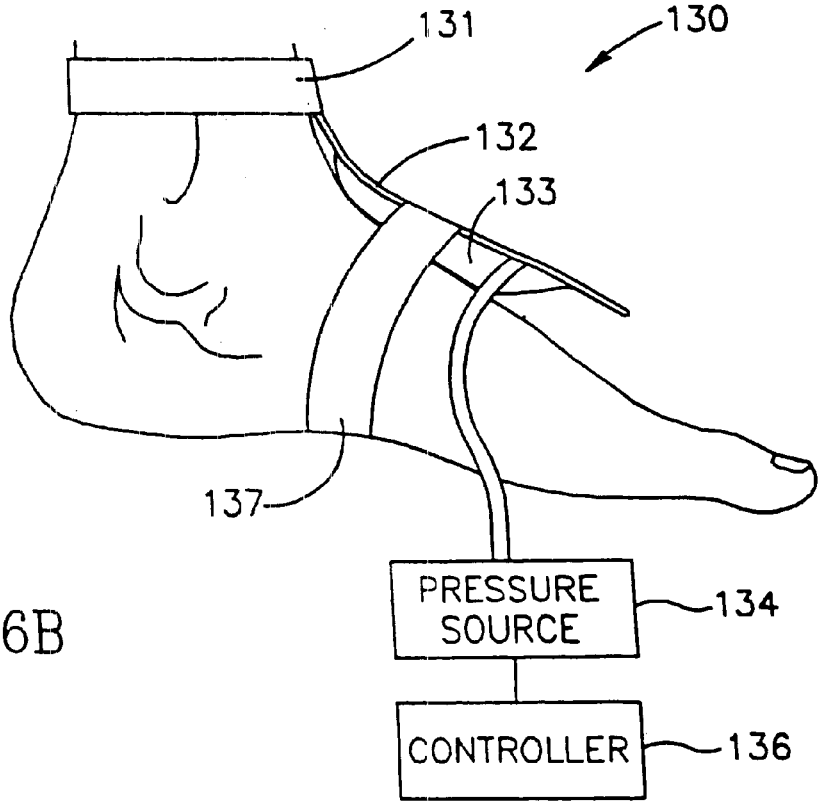

With reference now to FIGS. 16A and 16B, a medical device 130 for plantar flexion of a subject's foot has a mounting member 131 for mounting the medical device 130 on a subject's leg. A support member 132 is substantially rigidly attached to the mounting member 131 for disposition along most of the subject's foot's anterior surface. An inflatable bladder 133 extends along the underside of the support member 132, and is in fluid communication with a pressure source 134 under the control of a controller midway along to the support member 132 encircles the subject's foot's plantar arch whereupon cyclic inflation and deflation of the inflatable bladder 137 effects cyclic plantar flexion of the subject's foot thereby facilitating emptying of his foot's venous plexus and activating his calf's venous muscular pump to pump venous blood from the subject's foot and leg towards his heart.

Various modifications and changes may be made in the configurations described above that come within the spirit of the invention. The invention embraces such changes and modifications coming within the scope of the claims appended hereto. For example, an inflatable bladder disposed under a foot's plantar arch can be divided into two inflatable bladders respectively disposed under a plantar arch's medial portion and its lateral portion. The medical devices 90, 100, 110 can also be provided with a heel support 72, and a foot strap 73. The wheelchair 120 can be provided with a medical system for applying any suitable cyclic action to a subject's feet by way of one of the medical devices described herein.

What is claimed is:

1. A medical device apparatus that facilitates blood circulation in a subject's lower limb by motivating physiological actuation of active motorical mechanisms, the device comprising:

a boot having a sole having an upper surface;

an inflatable chamber disposed atop the sole;

a channel recessed in the upper surface of the sole; and a pressure source coupled to the inflatable chamber, the pressure source configured to cyclically inflate and deflate the inflatable chamber.

2. The device of claim 1, wherein the channel guides a tubular element to the inflatable chamber.

3. The device of claim 2, wherein the tubular element fluidically couples the pressure source to the inflatable chamber.

4. The device of claim 1, wherein the channel comprises an entrance.

5. The device of claim 4, wherein the entrance is disposed on a lateral edge of the sole.

6. The device of claim 4, wherein the entrance is disposed on a forward lateral edge of the sole.

7. The device of claim 4, wherein the entrance is disposed on a rearward lateral edge of the sole.

8. The device of claim 4, wherein the entrance is disposed on an underside of the sole.

9. The device of claim 1, wherein the inflatable chamber is configured to selectively apply pressure to the toes of the subject's foot.

10. The device of claim 1, wherein the inflatable chamber is configured to selectively apply pressure to the metatarsus of the subject's foot.

11. The device of claim 1, wherein the inflatable chamber is configured to selectively apply pressure to the front portion of the subject's foot, to elevate substantially the front portion relative to the heel.

12. The device of claim 1, wherein the pressure source is configured to inflate and deflate the inflatable chamber responsive to subject control.

13. A device for facilitating blood circulation in a subject's lower limb by actuating passive motorical mechanisms and motivating physiological actuation of active motorical mechanisms, the device comprising:

a boot having a sole having an upper surface;

a plurality of inflatable chambers disposed atop the sole;

a plurality of channels recessed in the upper surface of the sole; and a pressure source coupled to the plurality of inflatable chambers, the pressure source configured to cyclically and independently inflate and deflate the plurality of inflatable chambers.

14. The device of claim 13, wherein the plurality of channels guides a plurality of tubular elements to the plurality of inflatable chambers.

15. The device of claim 14, wherein the plurality of tubular elements fluidically couples the pressure source to the plurality of inflatable chambers.

16. The device of claim 13, wherein the plurality of channels comprises a plurality of entrances.

17. The device of claim 16, wherein the plurality of entrances is disposed on a lateral edge of the sole.

18. The device of claim 16, wherein the plurality of entrances is disposed on a forward lateral edge of the sole.

19. The device of claim 16, wherein the plurality of entrances is disposed on a rearward lateral edge of the sole.

20. The device of claim 16, wherein the plurality of entrances is disposed on an underside of the sole.

21. The device of claim 13, wherein the plurality of inflatable chambers are disposed atop the sole in a non-overlapping fashion.

22. The device of claim 13, wherein the plurality of inflatable chambers individually engage different portions of the underside of the subject's foot.

23. The device of claim 13, wherein the pressure source is configured to inflate and deflate the plurality of inflatable chambers to simulate walking activity.

24. The device of claim 13, wherein the pressure source is configured to inflate and deflate the plurality of inflatable chambers to simulate running activity.

25. The device of claim 13, wherein the pressure source is configured to inflate and deflate the plurality of inflatable chambers to simulate standing activity.

26. The device of claim 13, wherein the pressure source is configured to independently inflate and deflate each of the plurality of inflatable chambers responsive to subject control.

* * * * *